United States Patent [19]

Hübner et al.

[11] Patent Number: 4,609,297

[45] Date of Patent: Sep. 2, 1986

[54] PRINT AND CORRECTION RIBBON DRIVE SYSTEM

[75] Inventors: Manfred Hübner, Nuremberg; Wilfried Rettke, Altdorf, both of Fed. Rep. of Germany

[73] Assignee: Triumph Adler AG, Nuremberg, Fed. Rep. of Germany

[21] Appl. No.: 667,577

[22] Filed: Nov. 2, 1984

[30] Foreign Application Priority Data

Nov. 18, 1983 [DE] Fed. Rep. of Germany ..... 3341673

[51] Int. Cl.[4] ..... B41J 35/23; B41J 33/16; B41J 29/26

[52] U.S. Cl. ..... 400/187; 400/214; 400/225; 400/212; 400/236; 400/697.1

[58] Field of Search ..... 400/185, 212, 254, 223, 400/225, 236, 697, 697.1, 187, 215.3, 214, 232, 236.1, 236.2

[56] References Cited

U.S. PATENT DOCUMENTS 4,407,594 10/1983 Link ..... 400/697.1
4,511,270 4/1985 Bohmer ..... 400/697.1
4,533,267 8/1985 Kurachi et al. ..... 400/214

FOREIGN PATENT DOCUMENTS 38215 10/1981 European Pat. Off. ..... 400/697.1

OTHER PUBLICATIONS

"Unique Cam Arrangement for Printer Ribbon Feed"; Pyrcell et al., *IBM TDB;* vol. 26, No. 1, pp. 67–68; Jun. 1983.

"Proportional Ribbon & Correction Feed Mechanism . . . "; Mink et al; *IBM TDB;* vol. 26, No. 1, pp. 292–293; Jun. 1983.

"Variable Life & Feed . . . "; *Greenlief et al; IBM TDB;* vol. 26, No. 3B, pp. 1580–1582; Aug. 1983.

*Primary Examiner*—Edgar S. Burr
*Assistant Examiner*—David A. Wiecking
*Attorney, Agent, or Firm*—Joseph R. Spalla

[57] ABSTRACT

A drive system to raise and transport both print and correction ribbons on typewriters or like machines is powered by a single bidirectional stepping motor. In one direction of rotation the motor acts via a special action clutch to first drive mechanisms for raising a print ribbon and then to establish gear connections for driving mechanisms for transporting the print ribbon. In the other direction, the motor acts to establish gear connections for driving mechanisms for raising and transporting a correction ribbon.

2 Claims, 2 Drawing Figures

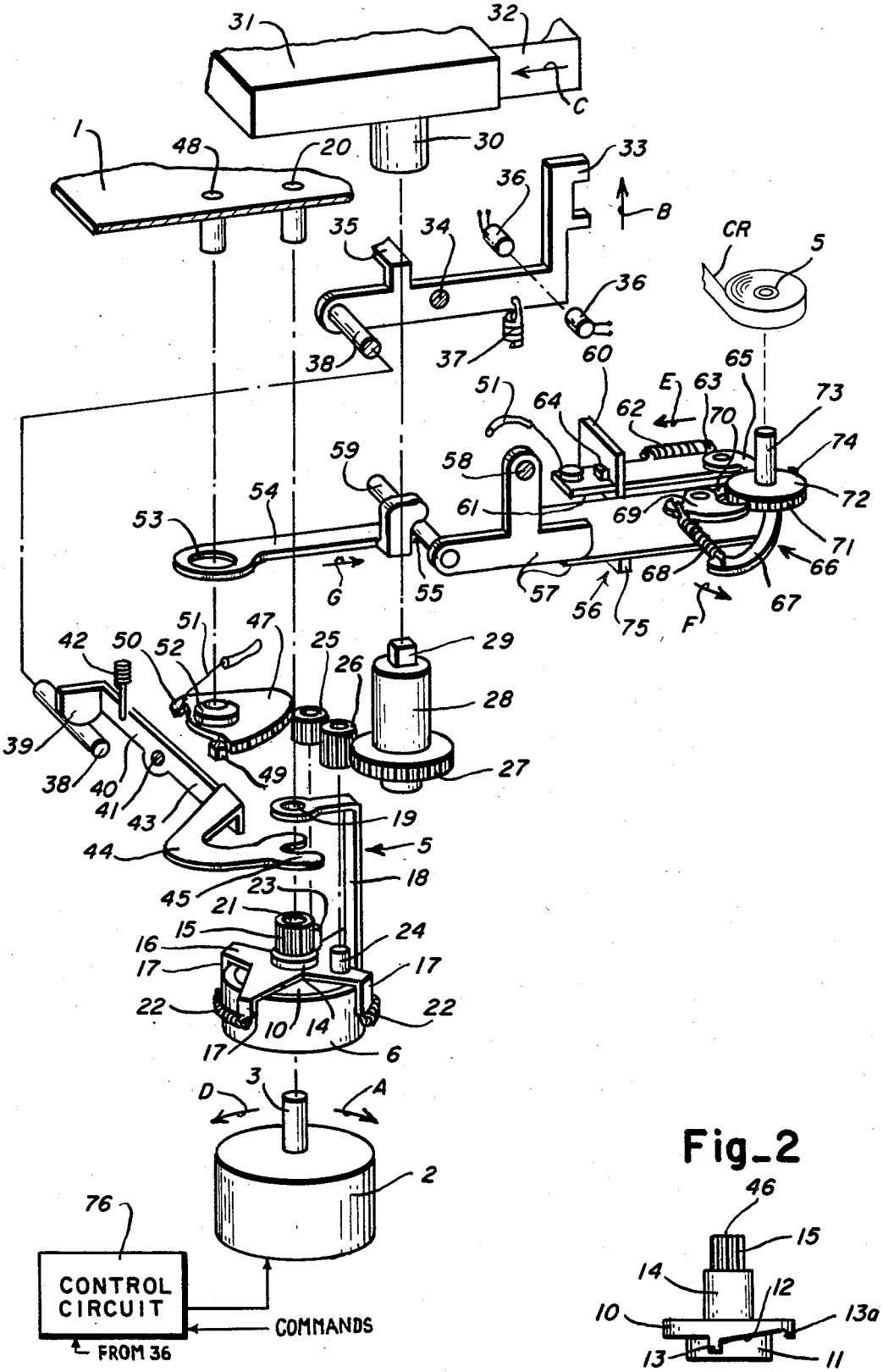
Fig_1
Fig_2
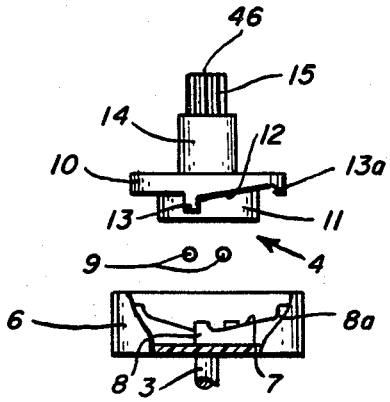

PRINT AND CORRECTION RIBBON DRIVE SYSTEM

This invention relates to a drive system to raise and transport both print and correction ribbons in typewriters or like machines; more particularly, it relates to a drive system having a single bidirectional stepping motor for powering, according to its direction of rotation, connections established by motor direction for driving mechanisms for raising and transporting either a print ribbon or a correction ribbon.

BACKGROUND OF THE INVENTION

German Pat. DE-PS No. 29 19 209 discloses a system for raising either a print or a correction ribbon via cams driven by a single bidirectional motor, the direction of motor rotation determining which ribbon will be raised. In this system, however, the print ribbon is lowered to its normal position after each print action as is necessary in typewriters to clear the view of the typing line. In memory controlled printer operation when the rate of printing is higher, this would be disadvantageous because it limits the rate of printing. Moreover, the noted German patent says nothing regarding ribbon transport.

Copending U.S. application, Ser. No. 571,451 filed Jan. 17, 1984 also shows a single motor for powering different types of ribbon, in, e.g., a printer. This application does not mention correction ribbons.

U.S. Pat. No. 4,407,594 relates to a drive system having a motor for raising and transporting a print ribbon but only for raising a correction ribbon. The correction ribbon transport is powered by a Bowden wire connection to an electromagnet which is also operative to switch drive connections between print and correction modes. Here, too, the print ribbon returns to lowered position after each print action and is therefore ill suited to use in high speed printer operation.

SUMMARY OF THE INVENTION

In accordance with the invention, a single bidirectional stepping motor, solely according to its direction of rotation, serves to raise and transport a print or a correction ribbon. In a print ribbon mode, the direction of motor rotation serves first to establish connections for driving mechanisms for raising the print ribbon and then to establish and to drive gear connections to transport the print ribbon. In the correction mode the direction of the motor establishes and drives gear connections to effect raising and transport of the correction ribbon.

A feature of the invention resides in mechanism to effect the sequential operation of the connections to raise and then transport the print ribbon and, if print commands are rapid, to maintain the print ribbon in raised position.

An object of the invention is to provide a print and correction ribbon drive system powered solely by means of a single motor.

Another object of the invention is to provide connections between a motor adapted when driven in a print mode for first raising the print ribbon and then to establish and to cyclically drive gear connections to transport the print ribbon in response to rapid print commands while the print ribbon maintains its raised position.

Another object of the invention is to provide a ribbon drive system wherein a print ribbon may be raised and lowered in low speed typewriter application and be raised and maintained in raised position in high speed printer applications.

Other objects, features and advantages of the present invention will become better known to those skilled in the art from a reading of the following detailed description when taken in conjunction with the accompanying drawing wherein like reference numerals designate like or corresponding elements throughout the several views thereof and wherein:

FIG. 1 is an exploded perspective view of essential elements constituting the invention; and FIG. 2 is an exploded elevational view, partly in cross section showing detals of the clutch shown in FIG. 1.

With reference to the drawing, it is to be noted that parts such as bearing seats, screws, etc. have been omitted for better clarity of the drawing. Also, as is usual in exploded views, not all the parts and subassemblies are depicted in the precise position which they will assume in the machine. Dashdotted connecting lines indicate the structural or functional correlation of individual parts.

Having reference now to FIG. 1, there is shown a plate 1 for supporting the various components comprising the invention, it being understood that additional support plates could be used. Suitably fastened to support plate 1 is a motor 2, preferably a stepping motor, having an output shaft 3. The output shaft 3 is secured to a special clutch, generally designated by reference numeral 4 which when driven produces axial and rotational output motions, as will hereinafter appear, which are coupled to gear change mechanism generally designated by reference numeral 5.

Referring to FIG. 2 in particular, the clutch 4 consists of a lower cup shaped part 6, which is open towards the top, to which the shaft 3 of motor 2 is secured. In its interior the lower clutch part 6 has two circularly disposed cams 7 with limit abutments 8, the cams being staggered by 180° relative to each other and oriented upwardly in axial direction. A ball 9 is put on each cam 7 before an upper part 10 of the clutch 4 is placed into the lower part 6. In its center, the upper clutch part 10 has a downwardly oriented ring 11 and also circularly disposed cams 12 with limit abutments 13. The cams 12 rest on the balls 9 from the top. Molded to the upper clutch part 10 is an upwardly oriented collar 14, adjoined by a small diameter gear 15. After the assembly of clutch 4 it forms a closed, circular housing which traps the balls 9 between the cams 7 and 12. Radial motion of the balls 9 is constrained by the ring 11 and by the wall of the cup shaped lower part 6. The lower and upper clutch parts 6 and 10 may be plastic injection moldings.

Referring again to FIG. 1, the gear change mechanism 5 has a cross yoke 16 with four downwardly bent arms 17 which embrace the outer periphery of the lower clutch part 6. The cross yoke 16 has a central hole whereby it can be freely rotatably mounted about a collar 14 of the upper part 10 of clutch 4. Another arm 18 of the yoke 16 extends upwardly in an axial direction and at the end thereof has an inwardly bent portion which has a hole 19 adapted to be penetrated by a pin 20. The pin 20 is fastened to the support 1 and extends far enough down beyond hole 19 as to engage also an axial hole 21 in the clutch output gear 15. By means of the pin 20, therefore, both the upper part of the cross yoke 16 and the upper clutch part 10 are rotatably mounted. In a manner yet to be described, the upper clutch part 10 is also mounted for axial movement. Hooked during assembly between two arms 17 each of the cross yoke 16 are extension springs 22 which serve to frictionally connect the periphery of the lower clutch part 6 and the cross yoke 16.

Attached to each of two adjacent arms 17 of the cross yoke 16 is a bearing pin 23 and 24, each of which serves to rotably mount a pinion 25 and 26. In their assembled state these pinions are in mesh with the output gear 15 of the clutch 4.

Mounted within the pivoting range of the pinion 26 in the support 1 is a gear 27 which has a ratchet in its hub to allow the gear 27 to turn in one direction only. Such ratchets are known as roller or ball ratchets and, therefore, are neither detailed nor described. The hub 28 of gear 27 has at its free end a driver 29 which can be coupled to a clutch part 30 on the print ribbon cassette 31 so that the print ribbon 32 is transported.

The print ribbon 32, in the area of the point of reproduction, is guided in a ribbon guide 33 which can pivot up and down about a bolt 34. A cross bridge 35 represents a connection to the second ribbon guide which, however, is not shown. Above the upper edge of the ribbon guide 33 is a light barrier assembly 36 whose light beam is interrupted when the ribbon guide 33 has raised the ribbon 32 to the level of the typed line. A spring 37 tends to pull the ribbon guide 33 down.

Attached to the free end of the ribbon guide is a pin 38 which projects under a bent portion 39 formed on one arm of a lifting lever 40 which pivots about a shaft 41. A spring 42 tends to turn the lifting lever 40 clockwise as viewed in FIG. 1. The other arm 43 of the lifting lever 40 has a formed section 44 which ends in a fork 45. This fork embraces the pin 20 on the support 1 while resting on the face 46 (FIG. 2) of the gear 15. The spring 42 maintains contact between the fork 45 and the gear 15.

A gear segment 47 is mounted so as to pivot about a pin 48 of the support 1 in the pivoting range of the pinion 25 of the gear change mechanism 5. In its normal position, the gear segment 47 rests against a stop 49 which may be a bent tab molded to the support 1. The gear segment 47 has a hook 50 to which is hooked one end of a pulling means, such as a Bowden wire pull 51. Furthermore, the gear segment 47 has an eccentric 52 which is accommodated with the hole 53 of a push lever 54. The other end of the push lever 54 has a mouth 55 which embraces a correction ribbon drive mechanism 56.

The correction ribbon drive mechanism 56 consists essentially of two pivoting arms 57, only one of which is shown, which are mounted at 58 and are interconnected by a connecting rod 59. The pivoting arm 57 shown in the drawing accommodates the windup spool S for the correction ribbon CR. The other pivoting arm 57, not shown, supports the correction ribbon supply spool.

Attached to the pivot arm 57 is a guide 60 in which a slide 61 is mounted so as to be movable. The other end of the Bowden wire pull 51 is hooked to this slide 61. The slide 61 is spring loaded by a spring 62 whose other end is hooked to a protrusion 63 of the pivot arm 57. As viewed in FIG. 1, the spring 62 tends to pull the slide 61 to the right so that a stop 64 of the slide 61 makes contact with the guide 60.

The other end of the slide 61 is linked to an arm 65 of a three-armed lever generally designated by reference numeral 66 which is rotatably mounted to the pivot arm 57. Hooked to the second arm 67 of the three-armed lever 66 is a spring 68 whose other end is hooked to a pawl 69 pivotally mounted to the third arm 70 of the three-armed lever 66. The pawl 69 engages the teeth 71 of a transport gear 72 having a shaft 73 to which a correction ribbon windup spool is to be mounted for rotation therewith. A no back ratchet 74 is associated with the transport gear 72. In its normal position, the pivot arms 57 rest against a stop 75.

In the following are described the various operating modes, reference to preceding specification parts being made in order to avoid repetitions. The entire mechanism is controllable by means of an electronic control circuit 76 which in response to commands furnishes to the motor 2 appropriate motor pulse sequences for the various modes.

Print Ribbon Raising and Transport

Upon the actuation of a typewriter key the ribbon guide 33 with the ribbon 32 must be raised to the level of the typed line and the print ribbon 32 must subsequently be transported. To accomplish this, the control circuit 76 issues programmed pulse sequences to energize the windings of motor 2 so that it turns by a predetermined number of steps in the direction of arrow A. As a result of the rotation in direction A, the lower part 6 of the clutch 4 turns in the same direction causing the cross yoke 16 to be rotated by means of the springs 22 which frictionally engage the lower clutch part 6. The rotation of the cross yoke 16 brings the pinion into engagement with the gear 27, if it is not already in this position. Due to a certain force required to transport the print ribbon 32, the clutch 4 will first select the path of lesser resistance, which is predeterminable by the design of the respective transmission trains and by the choice of the active spring forces. This means that the rotation of the lower clutch part 6 will cause the balls 9 to run up along the cams 7 of the clutch 4, thereby acting through the cams 12 in the upper clutch part 10, to push the clutch part 10 upwardly until the balls 9 make contact with the upper limit abutments 8*a* or 13*a*. During this upward movement, clutch part 10 and gear 15 of the upper part 10 do not turn.

The upward motion of the upper clutch part 10 causes the lifting lever 40 to pivot about shaft 41, counter to the force of spring 42, causing the bent portion thereof 39 to exert a pressure on the pin 38. The effect thereof is that the ribbon guide 33 pivots upwardly in arrow direction B to present the print ribbon 32 opposite the typed line. This interrupts the light beam of the light barrier assembly 36.

The above-described processes are completed when the balls 9 in the clutch 4 contact the upper limit abutments 8*a*, 13*a*. The interruption of the light beam of light barrier assembly 36 is used to signal the control circuit 76, that the print ribbon 32 is raised for typing. Thereupon the control circuit 76 issues programmed pulse sequences to the motor 2 to turn it in arrow direction A by a predetermined number of additional steps. The balls 9 in the clutch 4 against the limit abutments 8*a*, 13*a* will now cause the upper clutch part 10 and, hence, the gear 15 to turn. This rotary motion is transmitted by the pinion 26, which has been swung into engagement with gear 27, to the gear 27 and thence, by means of the driver 29, to the windup device in the ribbon cassette 31. The ribbon 32 is thus transported in arrow direction C.

The size of the print ribbon transport steps, depending on which kind of print ribbon 32 is used, can be controlled by the control circuit 76 which in response to switches actuated by the respectively installed ribbon cassette 31 can be made to issue different pulse sequences to the motor 2 in accordance with a predetermined program.

In addition the interruption of the light beam of the light barrier assembly 36 sets a timer in the control circuit 76. If printing commands issue in rapid succession, i.e., before the timer times out, the motor 2 will continue to turn in direction A in response to following pulse sequences, the ribbon 32 will remain raised, the light beam will remain interrupted and only further stepwise transport of the ribbon 32 will result. It does not matter whether the speed of the printing command is memory controlled or determined by rapid manual input through the keyboard.

If further printing commands fail to arrive or printing commands arrive after the timer times out, the following happens: The timer informs the control circuit 76 that the predetermined time is exceeded. This causes the control circuit 76 to furnish to the motor 2 a pulse pattern causing it to turn in arrow direction D by a fixed number of steps. Thereby the transport steps for the ribbon 32 are naturally concluded. But in addition, the balls 9 in the clutch 4 run downwardly on the cams 7 as the clutch 4 turns, in consequence of which the upper part 10 is also moved downwardly. This process of the downward motion of the upper part 10 of the clutch 4 is guided by the pinion 26 being supported, as it were, by the gear 27 because the latter, due to the ratchet in its hub 28, cannot turn in the opposite direction. The lifting lever 40 is thereby turned back clockwise into its initial position so that the ribbon guide 33 can also pivot back, thereby reopening the light barrier assembly 36. The motor 2 then stops. The pinion 26 may then still be in engagement with the gear 27.

The above described raising, transporting and pivoting motions repeat constantly if typing occurs in a time sequence above that given by the timer. Only if the typing sequence is more rapid, e.g., in the case of a memory printout, no raising and lowering motion takes place, which results in considerable time savings.

Raising and Transporting the Correction Ribbon

If in the operation of the typewriter the usual correction key is actuated, the motor 2 is energized by a predetermined pulse sequence from the control circuit 76 so that it turns in arrow direction D by a certain number of steps. This causes the clutch 4, due to the friction provided by the springs 22, to turn the cross yoke 16 so that the pinion 26 disengages from the gear 27. Instead, the pinion 25 engages the gear segement 47. The balls in clutch 4 are at the bottom so that the upper part 10 is also turned counterclockwise by means of the limit abutments 8 and 13. This also turns the gear segment 47 counterclockwise, effecting two function cycles simultaneously.

First, the Bowden pull 51 pulls the slide 61, moving it in arrow direction E, countering the force of spring 62. This causes the three-armed lever 66 to turn in arrow direction F. This causes the pawl 60 to turn the transport gear 72, thereby bringing an unused portion of the correction ribbon CR to the impact point.

Secondly, the eccentric 52 of the segment 47 acts upon the push rod 54 so as to move it in arrow direction G. The engagement of the push rod 54 and the connecting rod 59 has the effect that the pivot arm 57 pivot counterclockwise so that the correction tape is brought to the level of the typed line.

After the correction is made, the motor 2, initiated by the control circuit 76, is turned back by the same number of steps in the opposite direction, e.g., arrow direction A. Accordingly, the gear segment 47 is returned to contact the stop 49 by means of the gear 15 and pinion 25, and the push lever 54 is moved opposite to the direction of arrow G by the eccentric 52. The pivot arms 57 pivot back and contact the stop 75. The correction ribbon is thus lowered. The spring 62 returns the slide 61 into its shown initial position, thereby keeping the gear segment 47 against the stop 49 by means of the Bowden pull 51.

The retracting pawl 69 slides across a few teeth 71 of the transport gear 72, the ratchet 74 preventing it from turning in the opposite direction. Now, either a new correction operation or a typing operation can be initiated, in which one of the above described raising and transporting processes for the print ribbon 32 or the correction tape is repeated.

As is evident from the above, the raising and transporting motions for the print ribbon 32 and for the correction ribbon CR can be controlled at relatively little cost for components.

The invention claimed is:

1. A ribbon system for typewriters or like machines accommodating a print ribbon and a correction ribbon, print ribbon raising mechanism, print ribbon transport mechanism, correction ribbon raising mechanism, correction ribbon transport mechanism, a bidirectional motor, means consisting of a control circuit for energizing said motor to rotate from a home position in a first direction and return to home position in response to print commands to effect printing through said print ribbon, and for energizing said motor to rotate from a home position in a second direction and return to home position in response to correction commands to effect printing through said correction ribbon, a first clutch part connected to be driven by said motor, a second clutch part coupled to be first driven in an axial direction in response to rotation of said first clutch part in said first direction by said motor, and thereafter in a rotary direction in response to further rotation of said first clutch part in said first direction, means responsive to the axial movement of said second clutch part for driving said print ribbon raising mechanism, means for sensing the raising of said print ribbon and for signalling said control circuit that said print ribbon is raised and, in response to said signal, causing said control circuit to effect further rotation of said motor in said first direction through an angle determined by the type of print ribbon in use, an output gear on said second clutch part, a third clutch part coupled to said first clutch part, said third clutch part carrying a first transmission gear engaging said output gear and being moveable thereabout for engagement with and thereafter to drive said print ribbon transport mechanism in response to said further rotation of said first clutch part in said first direction, and said third clutch part including a second transmission gear engaging said output gear and being moveable thereabout for engagement with and to drive said correction ribbon raising and transport mechanisms in response to rotation of said first clutch part in said second direction.

2. A ribbon system as recited in claim 1, said control circuit having means for establishing a predetermined time interval in response to signals from said sensing means that said print ribbon is raised, said control circuit being operative to further energize said motor for rotation of said motor in said first direction thereby to maintain said print ribbon in raised position and to effect transport steps while said print ribbon is maintained in raised position when print commands follow one another within a predetermined time interval, or to energize said motor for return to home position when a subsequent print command occurs after said predetermined time interval.

* * * * *